219-121 SR
12/2/86 OR 4,626,655

United States Patent [19]

Angerer

[11] Patent Number: 4,626,655

[45] Date of Patent: Dec. 2, 1986

[54] METHOD AND APPARATUS FOR WELDING ROLLED BANDS OF FINITE LENGTHS TO FORM CONTINUOUS BANDS DURING A MANUFACTURING OPERATION

[75] Inventor: Klaus Angerer, Roettenbach, Fed. Rep. of Germany

[73] Assignee: Siemens Aktiengesellschaft, Munich and Berlin, Fed. Rep. of Germany

[21] Appl. No.: 766,167

[22] Filed: Aug. 15, 1985

[30] Foreign Application Priority Data

Aug. 17, 1984 [DE] Fed. Rep. of Germany ..... 3430209

[51] Int. Cl.[4] ..... B23K 26/00

[52] U.S. Cl. ..... 219/121 LC; 219/101; 219/103; 219/104; 219/105; 219/121 LD; 219/121 LY

[58] Field of Search ..... 219/121 LC, 121 LD, 219/121 LY, 121 EC, 121 ED, 121 EX, 121 PJ, 121 PK, 101, 104, 105, 103; 228/44.3, 49.4, 5.7

[56] References Cited

U.S. PATENT DOCUMENTS

| | | | |
|---|---|---|---|
| 2,892,921 | 6/1959 | Mecklenberg | 219/105 X |
| 2,919,343 | 12/1959 | Rudd | 219/104 |
| 4,063,061 | 12/1977 | Fujino et al. | 219/101 |
| 4,069,375 | 6/1978 | Fujino et al. | 219/105 X |

*Primary Examiner*—C. L. Albritton
*Attorney, Agent, or Firm*—F. W. Powers; J. L. James

[57] ABSTRACT

The average winding diameter of a finite roller band length wound on a supply coil is increased by having the roller band rewound from the supply coil to a storage coil of a larger than the winding diameter, which encloses the supply coil concentrically. During the uncoiling of the band stored on the storage coil for purposes of a continuous manufacturing operation, a welding device is arranged in the annular area between the external diameter of the supply coil and the internal diameter of the storage coil and welds the band trailing end of the storage coil together with the band and leading end of the supply coil. The contents of the supply coil are then taken over by the storage coil, and while this material is uncoiled, a further supply coil is inserted and its leading edge welded to the end of the storage coil.

17 Claims, 10 Drawing Figures

METHOD AND APPARATUS FOR WELDING ROLLED BANDS OF FINITE LENGTHS TO FORM CONTINUOUS BANDS DURING A MANUFACTURING OPERATION

BACKGROUND OF THE INVENTION

This invention relates to the field of metalworking and more particularly to a method for welding finite metal bands into continuous bands during continuous processing of supply coils of the metal bands. The invention further relates to an apparatus for carrying out the method.

In order to be able to perform without interruption either a finishing or manufacturing operation using finite-length metal bands wound into so-called coils, it is necessary to weld the finite-length bands together without thereby interrupting the continuous further operation. In order to attain this goal, it is necessary to store a continously moving band material of a length adequate to permit the manufacturing unit to be continuously supplied from the storage of material during the welding cycle.

One method and apparatus for its implementation is known from German Pat. No. 2,934,115. In this procedure the moving band material is, for a specific duration, shaped and stored in the form of a band spool and then subsequently drawn from its spooled state for continuous further manufacturing or finishing. During this known process the band lengths to be welded are grasped at both ends and then wound jointly on a band spool in two layers and from opposite sides turning in the same direction of rotation. The cylindrically-shaped band spools consist of two sections, which include the welding unit so that the welding cycle is performed as the cylinder rotates. Prior to the method and apparatus described in German Pat. No. 2,934,115, moving band material had to be stored in the form of a band spool in one layer on a large cylinder for a specific duration, and an additional so-called feed-end twist length and a so-called discharge twist length of relatively extensive length were required. The German patented method has the advantage that its spatial requirements are substantially smaller. Admittedly, however, in this method a single cylinder is insufficient. Continuous manufacturing over a extended period of time rather requires a number of cylinders continuously interchanging positions and also requires a buffer length to handle the band material collected as the cylinders are repositioned.

It is desirable to have a method and apparatus which no longer requires either the relatively complicated two-section cylinder design or the relatively extensive repositioning process of the cylinders, or even an additional band buffer required by the previous method and apparatus.

With such a desired method and apparatus, one advantage is, that due to the relatively large diameter of the single storage coil, the welding device is not spatially restricted and is accessible with relative ease. In addition, the apparatus can be so constructed that it only requires simple rotary drives held in a constant mutual position and regulated accordingly. Particularly the elimination of the repositioning drives would provide a substantial simplification of the engineering complexity and thus also a reduction of the tendency for the system to malfunction.

SUMMARY OF INVENTION

Briefly stated in accordance with one aspect of the invention, the foregoing objects are achieved by providing a method for welding rolled bands of finite length into one continuous band during the operation of a manufacturing operation using electrical sensors and controls winding an initial band of finite length from a small diameter supply coil to a larger diameter, concentrically located storage coil which has a sufficient length to supply the band to the manufacturing operation during the welding of its trailing end to a subsequent band of finite length. The trailing end is clamped in the discharge side of a clamping and welding device located between the storage coil and the supply coil. After the trailing end of the initial band is secured, a subsequent band of finite length is inserted as a subsequent supply coil, and the leading end thereof is uncoiled into the feed side of the clamping and welding device. This subsequent leading end is clamped on the feed side of the clamping and welding device and then the two ends are welded together during the uncoiling of the storage coil into the manufacturing operation. The clamping and welding device is in a fixed position relative to the storage coil during the welding of the two ends.

This method is implemented in an apparatus for welding rolled bands of finite length to form a continuous band used in manufacturing having a disc-shaped mounting plate with a center and an axis normal to the center, and a mounting ring having an external diameter the same as the mounting plate being located parallel and coaxial with the mounting plate. A plurality of roller axes are distributed around the circumference of the plate and the ring and connected horizontally between them. A roller rotates about each of the axes forming collectively a roller ring. A removably mounted spindle driven by a drive mechanism for mounting the supply coil is located in the center of the roller ring and coaxial with the central axis. A clamping and welding device for driving the storage coil band and the supply coil band so that the trailing end of the former is clamped and welded to the clamped leading end of the latter. A control computer controls the apparatus providing a continuous supply of band to be used in the manufacturing operation by causing the welding of the mating ends before the storage coil has been completely exhausted.

In another embodiment of the invention, the method and apparatus form a further auxiliary coil between the supply coil and the storage coil.

A further embodiment of the method and apparatus of this invention uses a laser welding device as the welding unit, similar to the one described in European Patent Office published application No. A-0101016.

A further preferred embodiment uses as a welding device, the so-called foil seam welding device, described in German Pat. No. 3,011,144.

Said welding devices have the advantage that it is particularly easy to transmit the welding energy to the seam weld practically without losses while at the same time producing such a clean seam weld that any refinishing is either completely eliminated or can be reduced to a single operation.

It is also possible with the suggested apparatus to arrange the welding device at an angle to the central axis that the seam weld can run at a slight angle to the band conveying direction. Depending upon the further manufacturing stages, this can be advantageous in some cases.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
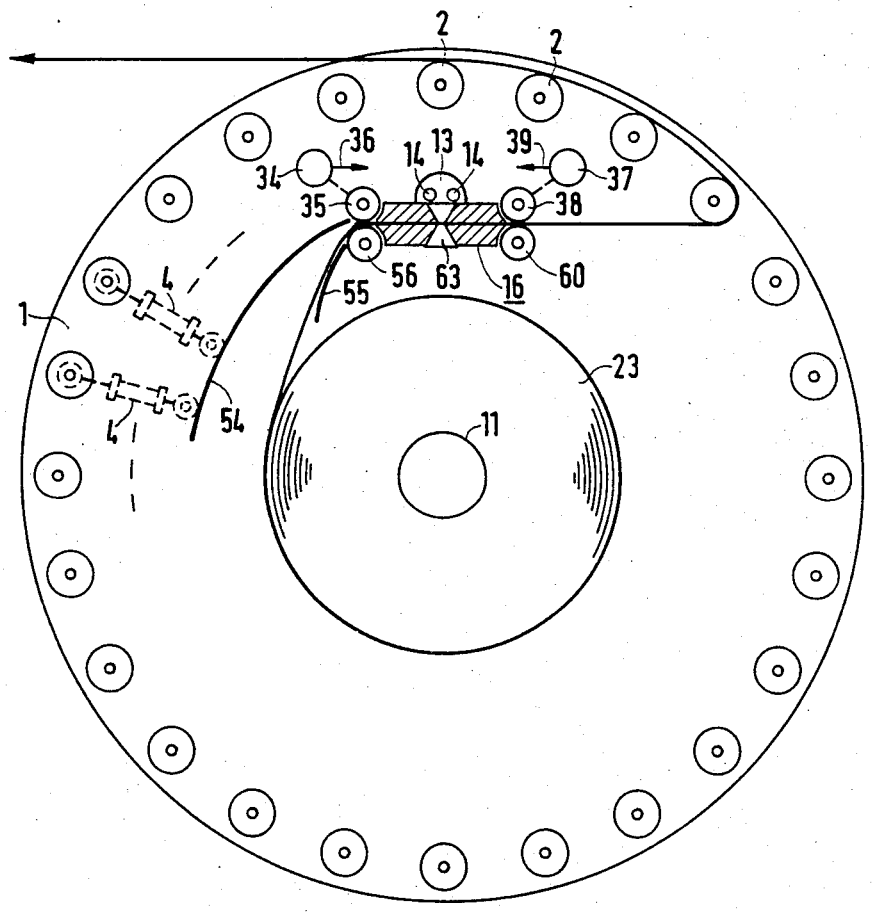
FIG. 1 shows a simplified frontal view of the apparatus with a rotating roller ring for the storage coil with the attached welding device.
Figure 2:
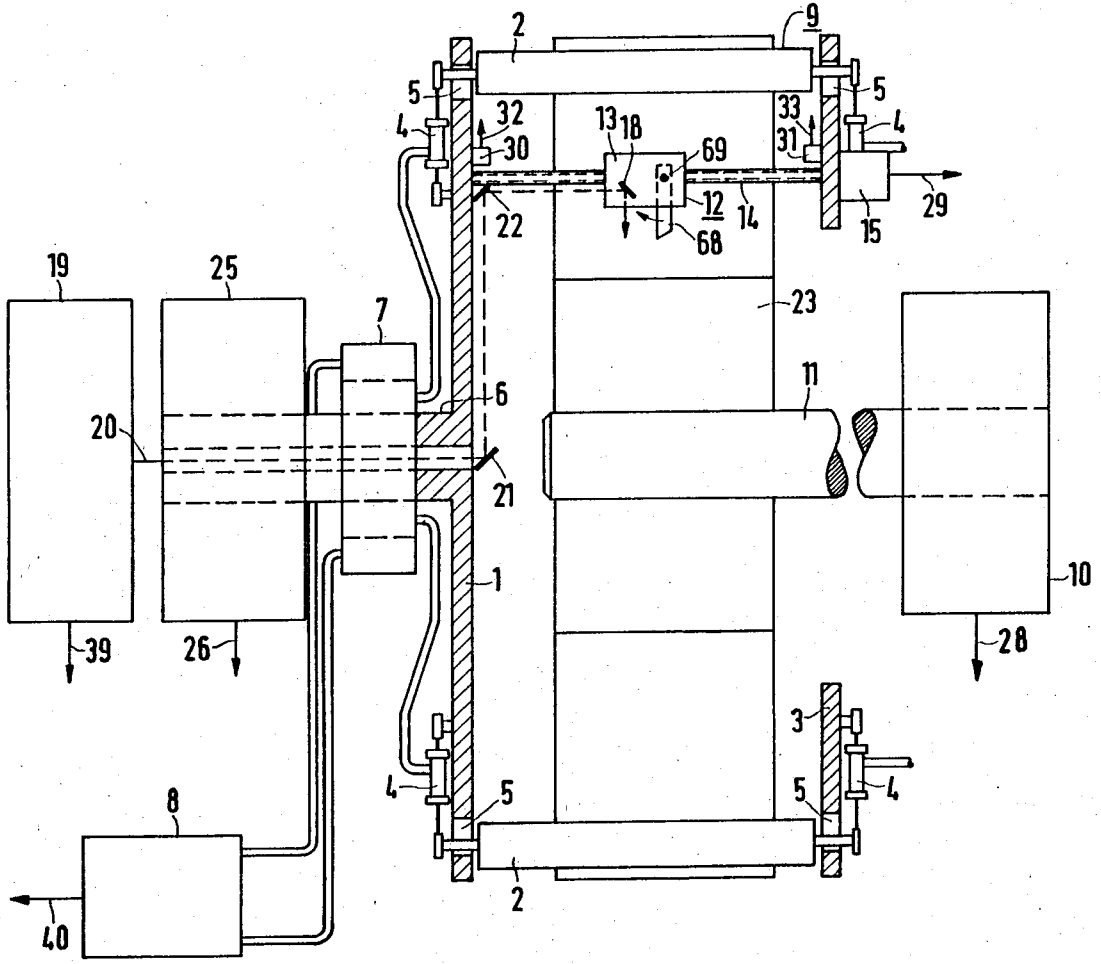
FIG. 2 is a cross-section through the apparatus shown in FIG. 1 on the level of the central axis.

The apparatus shown in FIG. 1 and FIG. 2 has a disc-shaped mounting plate 1 mounted in a rotating central axis. Along the exterior circumference of this plate a number of rollers 2 are mounted to rotate around horizontal axes, whose axes are positioned parallel to the rotating central axis of mounting plate 1. At one end these rollers are mounted in a radially movable fashion to mounting plate 1 and are similarly mounted as shown in FIG. 2 at their other end to a mounting ring 3. To permit the radial freedom, hydraulic cylinders 4 are attached to each roller axis on both mounting sides, which permit an individual radial shift for each roller within corresponding cutouts 5 in mounting plate 1 and mounting ring 3. By the use of self-resetting slide rings 7 mounted on drive shaft 6 of mounting plate 1, these hydraulic cylinders are connected to an electrically powered hydraulic pressure generator 8. In the rotating center of roller ring 9 formed by: mounting plate 1, rollers 2, mounting ring 3 and drive shaft 6, there is a spool spindle 11 driven by another electrical motor 10, whose rotating axis geometrically coincides with the central axis of drive shaft 6 of the roller ring. Spool spindle 11 with spool drive motor 10 can be moved out of the rotating center hydraulically, by devices not shown, in order to insert and handle new supply coils.

In the area between spool spindle 11 and rollers 2 of roller ring 9 the welding device 12 is installed. This consists of a slide rest 13, which can be moved by a slide drive 15 from spindles 14 in the direction of the central axis of the drive shaft 11. The spindles 14 are swivel-mounted beneath rollers 2 on the mounting plate 1 and mounting ring 3. Slide 13 operates in conjunction with a clamping device 16 further described in FIG. 5. Slide 13 includes a swivelling plane 17 as well as the final deflecting mirror 18 of a laser welding device whose energy ray generator 19 is located outside the apparatus. The ray 20 from this laser unit is routed through the drive shaft 6 designed as a hollow shaft over a first deflecting mirror 21 in the direction of the welding drive 12 and through a second deflecting mirror 22 in the direction of support 13 and from thence to the final deflecting mirror 18 and finally onto the welding seam.

All the control functions required to coordinate the control of the processing sequence, both for the startup as well as for the control of the drive devices, and the sensors are handled via control modules by a control computer 24 in accordance with the control program entered into it. In this embodiment of the invention the following units are connected to control modules 43 to 52 which, in turn, are connected to a central control computer 24: the drive motor 25 for the roller ring 9 over control line 26, the drive motor 10 for the spool spindle 11 of storage coil 23 over control line 28, the slide drive 15 over control line 29, both proximity switches 30, 31 for the slide drive over control lines 32, 33; motor 34 for the feed drive roller 35 over control line 36, drive motor 37 for the discharge drive roller 38 over control line 27, energy ray generator 19 over control line 39, the electrical hydraulic pressure generator 8 over a control line 40, and the electric hydraulic pressure generator 42 over control line 41. The central control computer is then connected by a further control line 53 to a not further shown host computer of the processing unit.

Figure 5:
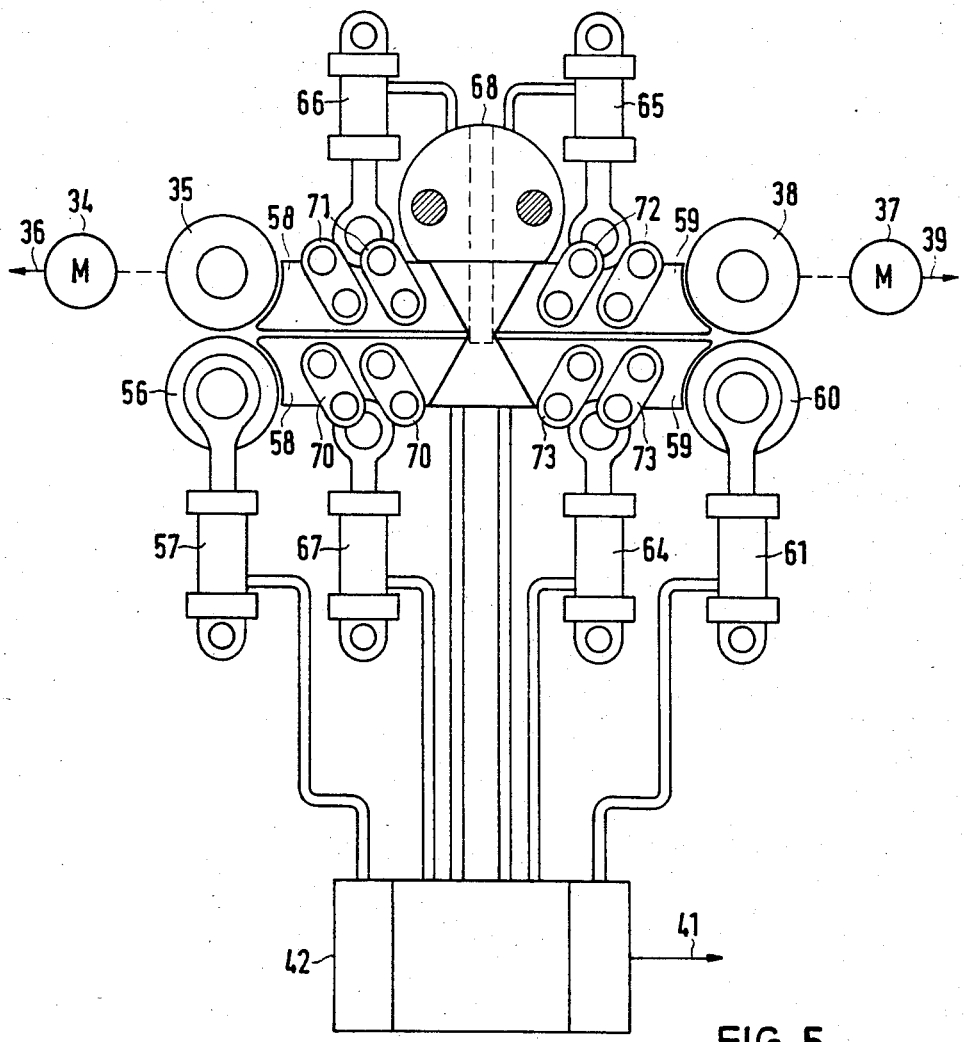
FIG. 5 shows a frontal view of the clamping and welding device.
Figure 6:
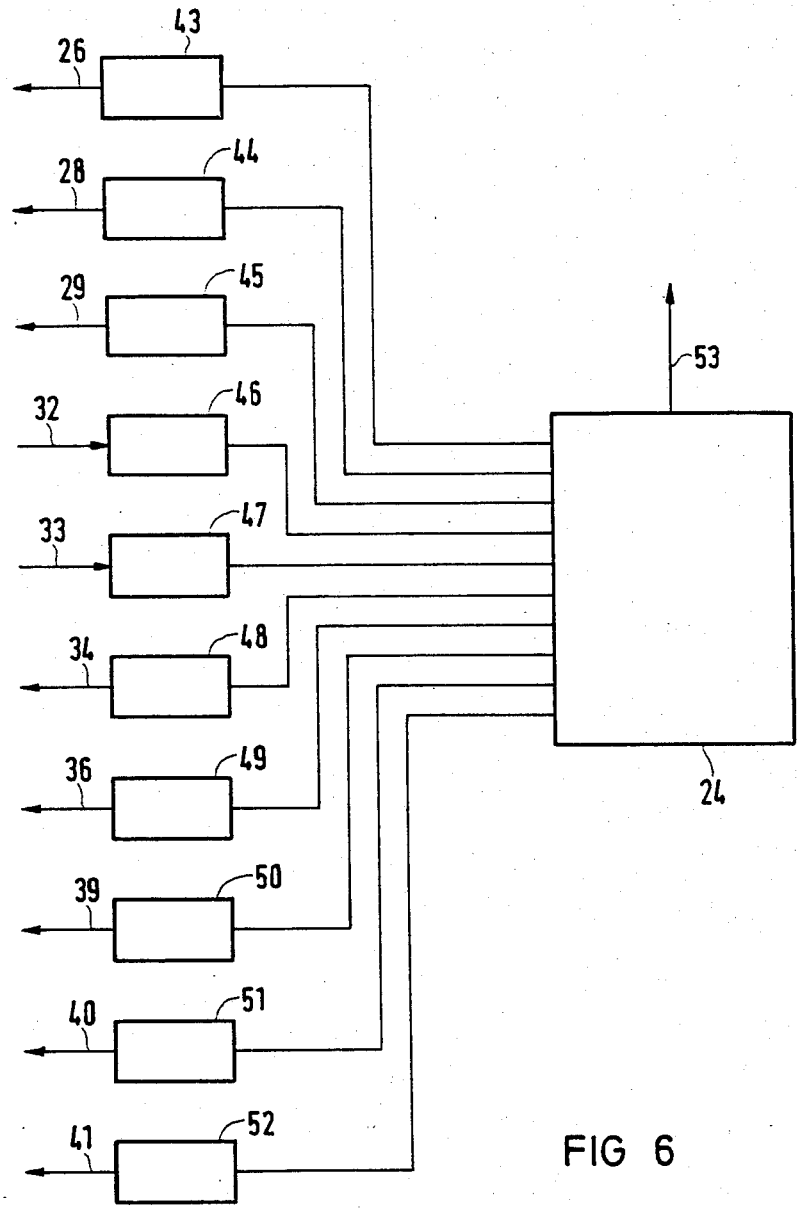
FIG. 6 is a functional schematic depiction of the electronic control device for the apparatus in accordance with FIGS. 1 and 3.

The function of the embodiment of the invention shown in FIG. 1, 2 and 5 will be described below. Before initiating the manufacturing unit, a supply coil 23 is introduced using the spool spindle 11 into the center of roller ring 9 so that it assumes the position shown diagrammatically in FIG. 2. The spool drive motor 10 is then operated until the frontal edge of the supply coil passes through the funnel-shaped guide plates 54, 55 between the feed drive roller 35 and the feed pressure roller 56. Subsequently, the spool drive motor 10 is switched off and hydraulic cylinder 57 of the feed pressure roller 56 switched on so that the leading edge of the supply coil is clamped between feed drive roller 35 and feed pressure roller 56. Then the drive motor 34 of feed drive roller 35 is switched on so that the band passes between the opened feed tensioning jaws 58 and the similarly opened discharge tensioning jaws 59 between the discharge drive roller 38 and discharge pressure roller 60. Then the hydraulic cylinder 61 of discharge pressure roller 60 is actuated, the hydraulic cylinder 57 of the feed pressure roller 56 released and then drive motor 37 of discharge drive roller 38 switched on so that the band, possibly over an additional, not-depicted guide mechanism, passes to the outside between two rollers of the roller ring. At the same time the band leading edge which passes to the outside is fed to a similarly not shown gripper which passes it into the manufacturing unit that has not been started up yet.

Figure 7:
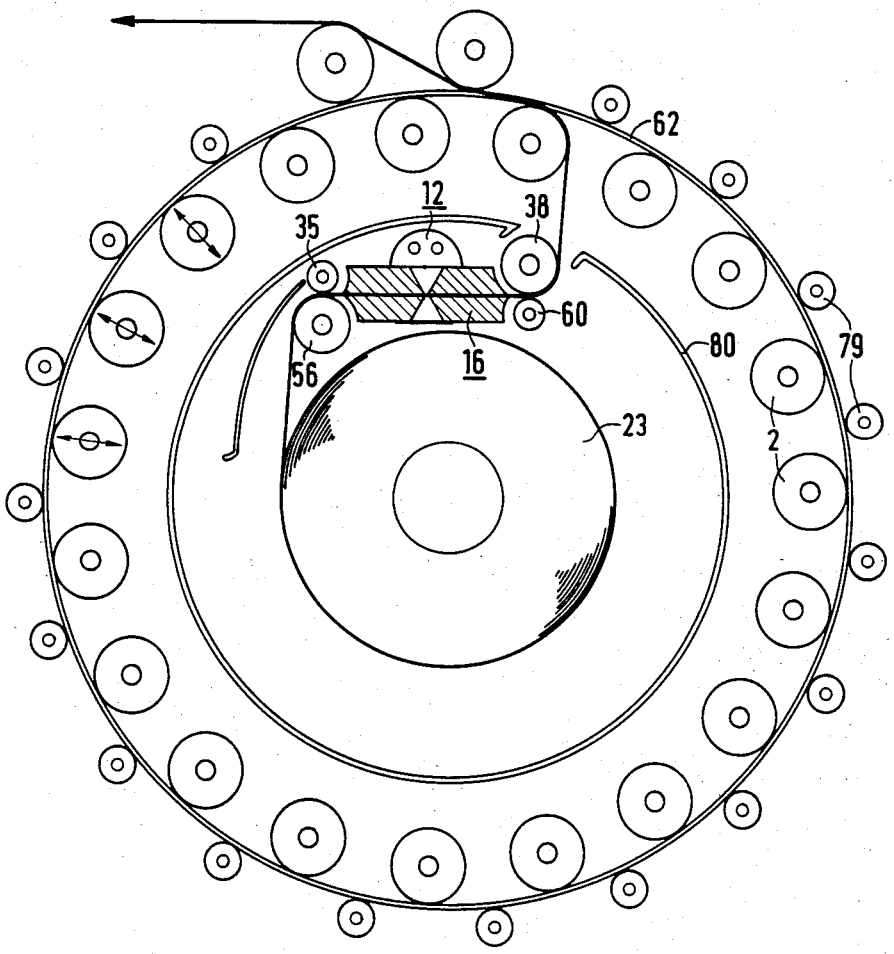
FIG. 7 shows a simplified frontal view of an apparatus according to the invention with a rotating roller ring; a concentrically arranged fixed-mounted form-generating roller ring around the roller ring; and a swivel-mounted auxiliary cylinder set concentrically on the inside, with a welding and clamping device fastened to it.

Now, by actuating its drive motor 25, the roller ring begins to rotate in the same direction as the winding direction of the supply coil 23, which is contrary to the rotation of the band, so that the band from supply coil 23 is wound outside onto the roller ring, thus forming the storage coil 62 shown in FIG. 7. After winding the first layer, the hydraulic cylinders 4 of each roller are actuated by the electrical hydraulic pressure generator 8 in such a fashion that the relevant roller can give so much in the direction of the rotating point layer by layer that the individual layers are wound together in response to the desired pressure. Drive motor 25 remains switched on in this direction of rotation until the band from supply coil 23 has been nearly fully unwound and reaches the feed drive roller 35. At that point its speed is reduced and finally its direction reversed until the band end has reached the slot between the feed side tensioning jaws 58 and the discharge tensioning jaws 59, which is the shaping and welding point. Then motor 37 is disconnected and hydraulic cylinders 64, 65 of the discharge tensioning jaws are actuated at such a pressure that the band end is clamped between the jaws. At this point the winding speed of the band end is the same as the band speed and storage coil 62 is wound. Subsequently, in accordance with the procedure for initiating the apparatus, a further supply coil is mounted on spool spindle 11 and inserted into the center of roller drive 9. Thereupon the procedure for inserting the coil leading edge with rotating clamping and welding device in their feed drive roller pair 35, 56, whose drive motor 34 after completing the pressure cycle is actuated until the start of a new supply coil band has again passed through the open feed tensioning jaws 58 into the processing slot between the feed tensioning jaws 58 and the discharge tensioning jaws 59 once again and contacts the band end of the preceding coil. Thereafter hydraulic cylinders 66 and 67 of the feed tensioning jaws 58 are actuated at a pressure required for them to clamp fast the coil end leading edge. Then slide 13, which is in its right end position (FIG. 2), is actuated by switching on slide drive 15 so that along with its planing or milling device 68 it planes the two mating ends held by the tensioned plate in a parallel fashion. After attaining the end position of slide 13, slide drive 15 is disconnected by proximity switch 30. The planing chips are thereby dropped into the receptacle 63. Simultaneously, the planing device lifts from its working into its resting position, rotating around its rotation point 69 in a clockwise fashion, by the use of devices which are not shown. Thereupon hydraulic cylinders 64, 65, 66, 67 are regulated in such a fashion by electrical hydraulic pressure generator 42 that all four tensioning jaws are moved towards each other by the parallelogram levers 70, 71, 72, 73 until the two level-planed plate edges mate once again. Then the energy ray generator 19 of the laser welding device is switched on and simultaneously slide drive 15 is moved in the opposite rotating direction so that the laser beam by use of the deflecting mirrors 21, 22 and 18 and a not shown focusing device is led over the planed edges and welds them together. As soon as slide 13 reaches its other end position, the slide drive 15 and the energy ray generator 19 are switched off by a corresponding pulse of proximity switch 31, the slide drive 15 is switched on again in reverse direction of rotation, and the planing device 68 is again swivelled into its working position. At the same time the planing device 68 is adjusted, by a not depicted means, in such a way that it now planes the face of the seam weld. After reaching the other end position, the proximity switch 30 again interrupts slide drive 15.

After complete unwinding of the storage coil 62 located on the roller ring, the hydraulic cylinders 64, 65, 66, 76 are discharged so that tensioning jaws 58, 59 open. At the same time, drive motor 37 of the discharge drive roller 38 is switched on and the direction of rotation of drive motor 25 of the roller ring reversed so that the roller ring again rotates clockwise and the band on the supply coil is again wound on the roller cage via rollers 2 as a storage coil. This procedure is continued until the band end has left the supply coil and has reached the feed driver roller 35. Subsequently, the process just described repeats itself. The dimensions and the speeds of the manufacturing plant are selected in such a way that the storage coil is always fully unwound after completion of each processing step.

The principle of the procedure then is to transfer the contents of a supply coil with a small diameter during the manufacturing process to a storage coil of a substantially larger diameter surrounding the supply coil concentrically, to weld both coils during the unwinding of the storage coil, and to insert a new supply coil. Thus, on the one hand, an adequately large ring-shaped space is developed between the two coils to install the clamping and welding device, and, on the other hand, adequate time is available to complete the welding cycle.

The above-described functional principle in accordance with FIGS. 1 and 2 can be further modified by having the supply coil 23 wound not outside the roller ring, but wound to fit on the inside. This then creates the opportunity to fix-mount the roller ring. Thereby, the unwinding from the supply coil 23 and the mating of the band takes place with the assistance of the clamp and welding device, which executes a rotating motion around the central axis of the roller ring. The basic design of this embodiment can be seen from FIGS. 3 and 4. Rollers 2 are once again fastened in a pivoting fashion around their central axis to a mounting plate 74 on the one hand, and on the other hand to a mounting ring 75, both of which are fixedly attached. Facing them is the clamping and welding device in accordance with FIG. 5 mounted onto an angle arm 76, which is connected with a central drive shaft 77. Said drive shaft is driven by motor 25. The drive shaft 74, the radial section of angle arm 76 and the spindle 78 are hollow for the passage of the energy ray coming from the energy ray generator 19. The deflecting mirrors 21 and 22 are mounted in the edges of the ray ducts and deflect the energy ray onto the deflecting mirror 18, which conducts it in the direction of the seam weld.

With this embodiment of the apparatus, the following processing sequence takes place: initially, as described in the start of the previous embodiment, with the processing unit not in operation, the leading edge of a supply coil is introduced into the center of the roller ring; it is conducted outwards through the clamping device using the discharge drive rollers 38 in conjunction with the pressure roller 60 between two suitable rimmed rollers; and from there it is passed to the manufacturing unit by devices not shown. Then the clamping and welding device 12, 16 is placed into rotary motion in a counter-clockwise direction by means of motor 25 via angle arm 76, whereby discharge drive roller 38 mates the first layer of the storage coil inside against rollers 2 of the roller ring and then winds the storage coil layer by layer. Once the end of the supply coil has reached the place for the seam weld, the already described functions are initiated and the manufacturing operation starts to run. At the same time motor 25 which operates the angle arm of the clamping and welding device 12, 16 is placed in operation and moves it in a clockwise direction around the central axis of the apparatus so that the storage coil is unwound. During this time a new supply coil is inserted and motor 10 switched on so that the supply coil similarly rotates in a clockwise direction at such an angular velocity that the leading edge of the band can be threaded through the funnel-shaped guide plates 54, 55 into the clamping and welding device rotating in the same direction in the fashion described previously. Then the welding device is actuated in the described fashion so that the edges of the band are welded together. After the storage coil has been completely unwound, motor 25 is stopped and restarted in the opposite direction of rotation, i.e., counter-clockwise, so that with the assistance of the discharge drive roller 38 with pressure roller 60, the supply coil is unwound and rewound again as the storage coil against the inside of the roller ring. This process repeats accordingly so that continuous operation is ensured. To compensate for the reduced external diameter of the storage coil when unwinding the storage coil, some of the rollers 2 of the roller ring can be mounted in a radially movable fashion either by spring pressure or due to a corresponding force resetting procedure.

Figure 3:
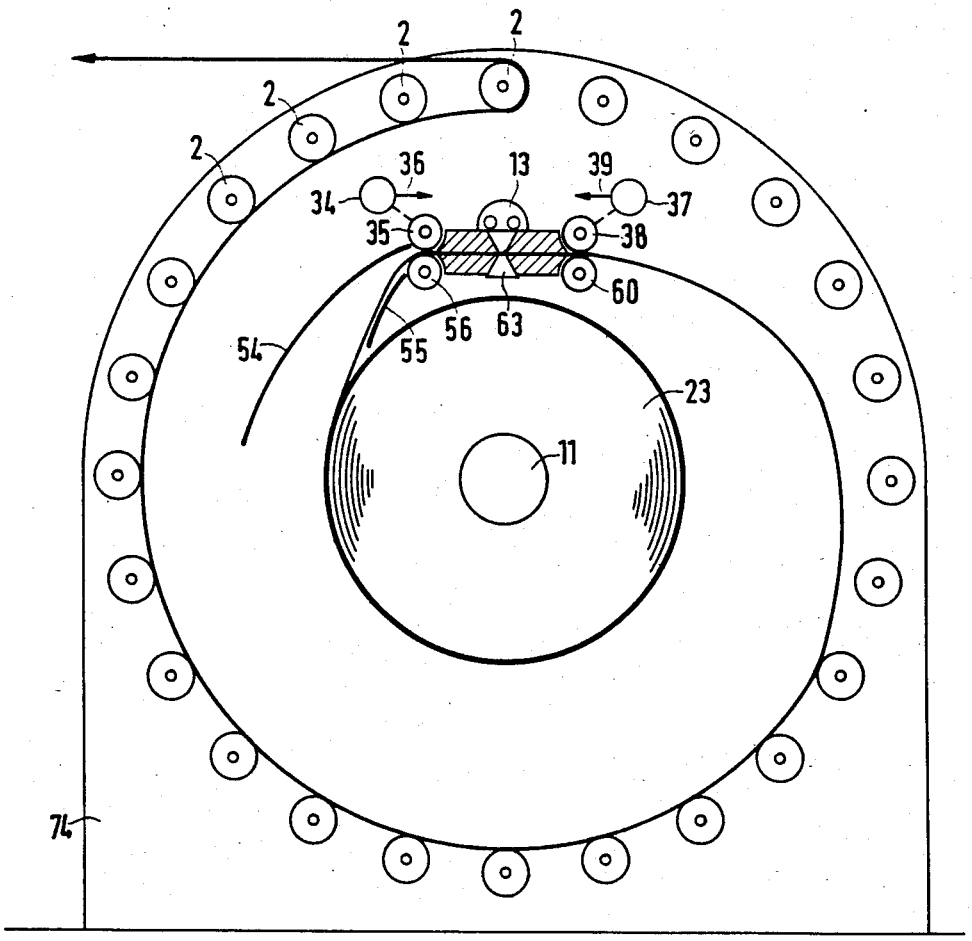
FIG. 3 shows a simplified frontal view of the apparatus with a fixed roller ring and a welding device which swivels around the central axis.
Figure 4:
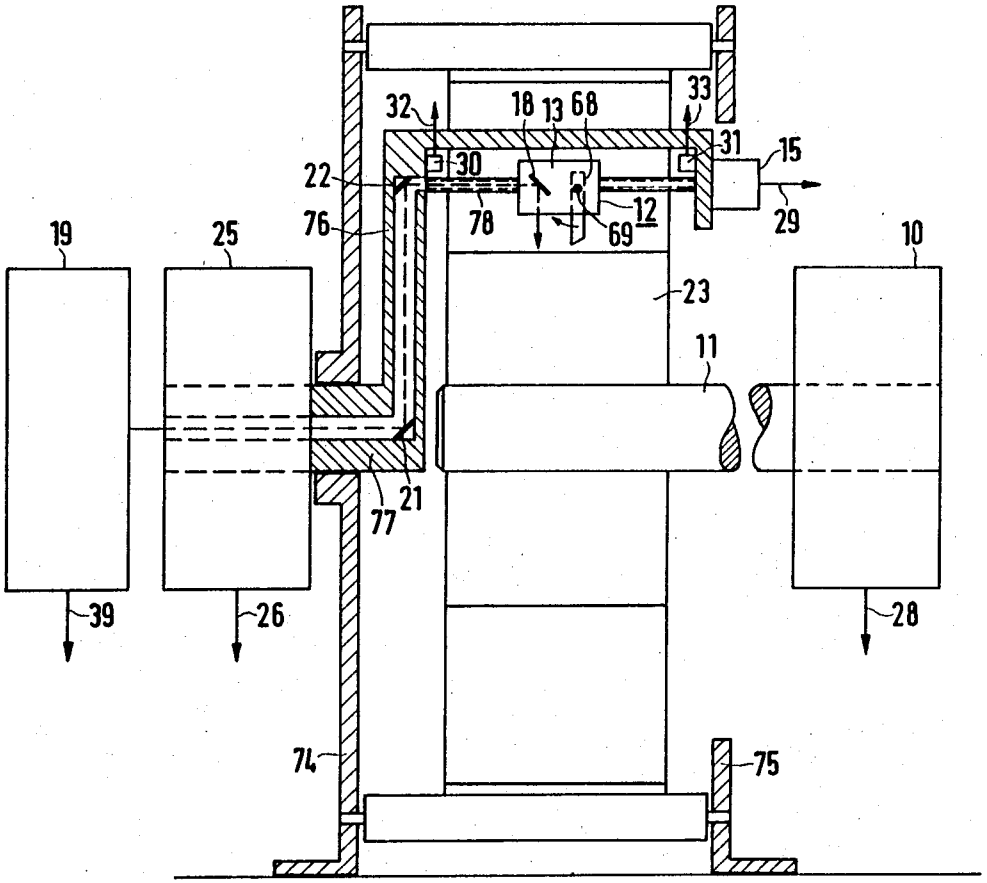
FIG. 4 is a cross-section through the apparatus shown in FIG. 3 on the level of the central axis.

In the apparatus described thus far the formation of the storage coil 62 takes place either by winding the band stored on supply coil 23 onto the outer circumference of the rotating roller ring 9 (FIG. 1), or by mating the band to the inner side of the fixed-mounted roller ring 9 (FIG. 3). Under certain conditions, wherein the material characteristics of the band play a determinative role, these embodiments of the apparatus and the corresponding procedures can be utilized. If these material characteristics are not present, however, the foregoing procedures can lead to problems insofar as the band can pull together in accordance with the apparatus of FIG. 1 to form a polygonal coil on roller ring 9 or, in accordance with the apparatus of FIG. 3, the first layer of the supply coil will not mate along the entire circumference with rollers 2 of roller ring 9. To be able to utilize this apparatus even in these kinds of cases, the embodiment in accordance with FIG. 1 is supplemented by a so-called form-generating roller cage (FIG. 7), wherein rollers 79 having the same width as rollers 2 are arranged around the latter in such a fashion that storage coil 62 is routed and shaped between the roller rings formed by rollers 2 and rollers 79.

Figure 10:
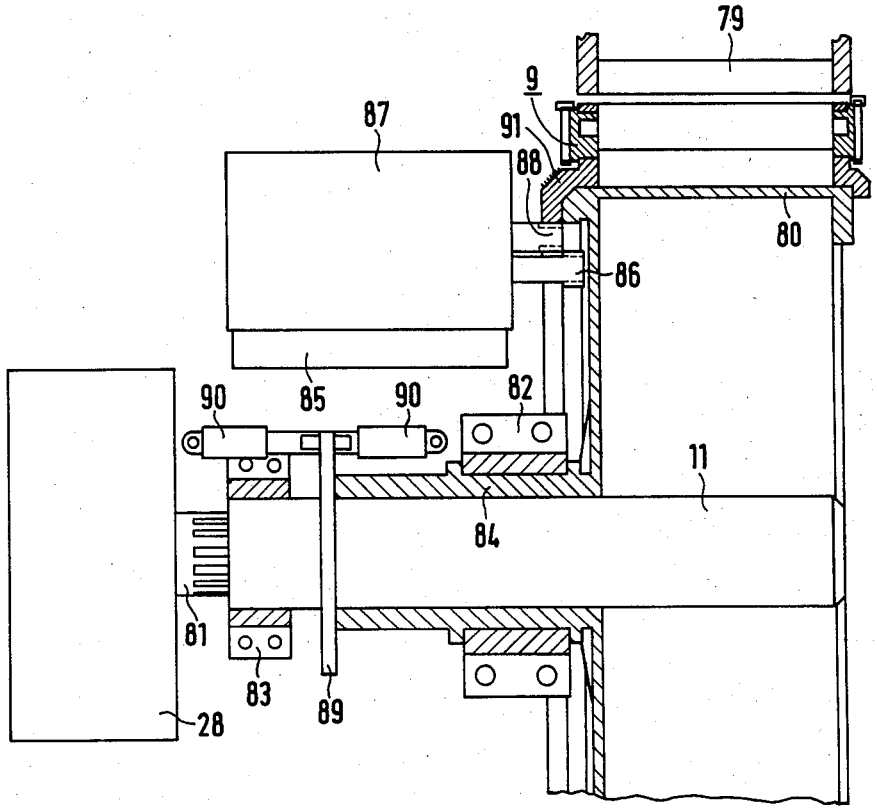
FIG. 10 is a cross-sectional view of the apparatus shown in FIG. 7.

In this context rollers 2 of roller ring 9 are again radially movable so that the space available between the two above-named roller rings can be adjusted to the winding diameter of the storage coil. In addition, the embodiment in accordance with FIG. 7 has a swivel-mounted auxiliary cylinder 80, which is rigidly connected to the welding and clamping device 12, 16 and rotates concentrically to bearing roller ring 9. Auxiliary cylinder 80 encompasses the space required for the supply coil and the welding and clamping device, whose width corresponds to that of the bearing roller ring 9, and whose diameter is, by the thickness of the auxiliary coil, less than the smallest internal diameter of the roller ring of the support roller cylinder. At the level of the discharge drive roller 38 of the clamping device 16 this auxiliary cylinder 80 has a slot to permit passage of the roller band. The cross-section of the apparatus shown in FIG. 10 shows the drive mechanism of the concentrically arranged functional elements. In this context motor 28 drives the spool spindle 11, which is single-point mounted in the frontal bearing 82 and rear bearing 83, by means of a multiple keyway shaft 81. The auxiliary cylinder 80, which is swivel-mounted concentrically on the spool spindle 11 by means of a bearing bushing 84, is driven by a motor 85 using a pinion ring gear 86 concentrically to the spool spindle. The roller ring 9 of bearing rollers 2 is fastened to a bearing ring 91 swivel-mounted concentrically on the bearing bushing 84 of auxiliary cylinder 80. Said mounting plate is driven by motor 87 using a pinion ring gear 88. In the vicinity of the rear bearing 83 of spool spindle 11, a positioning disc 89 is fastened thereon, which can be moved in an axial direction by hydraulic cylinders 90 by such a stroke that center deviations of the band being unwound from the supply coil can be corrected.

Figure 8:
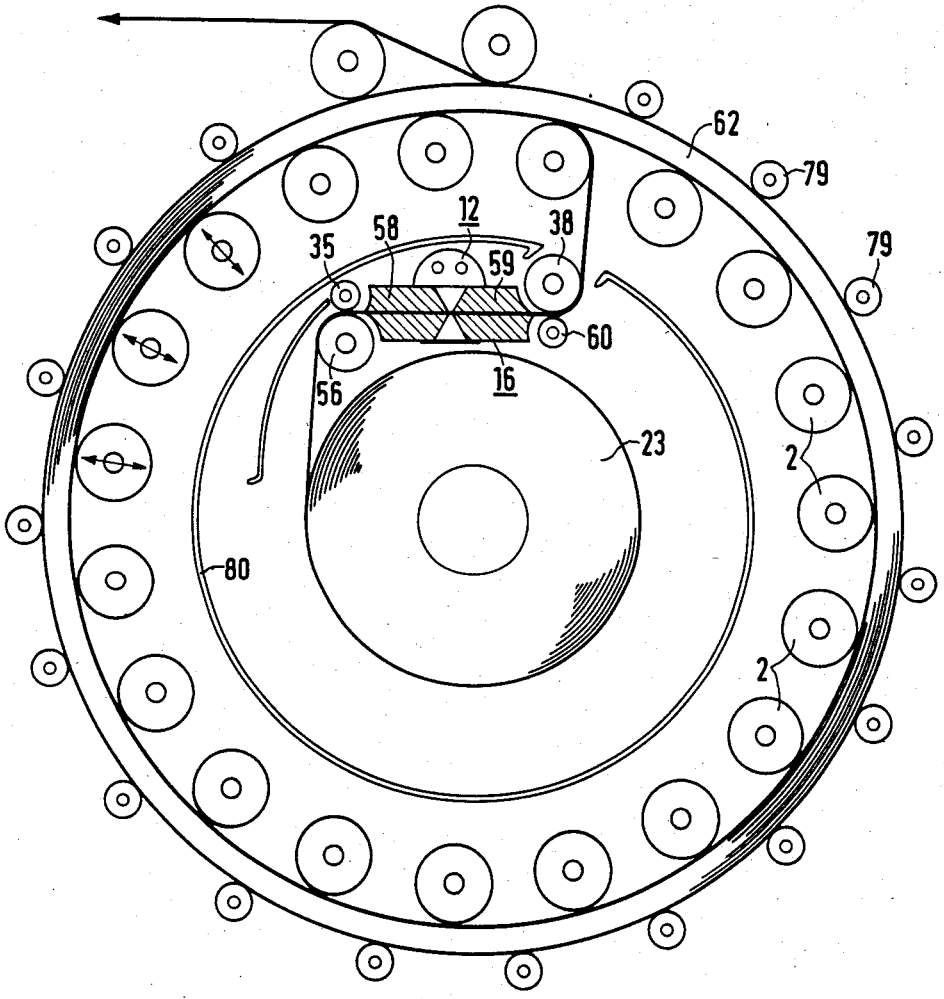
FIG. 8 shows the apparatus in accordance with FIG. 7 with a fully wound supply coil.
Figure 9:
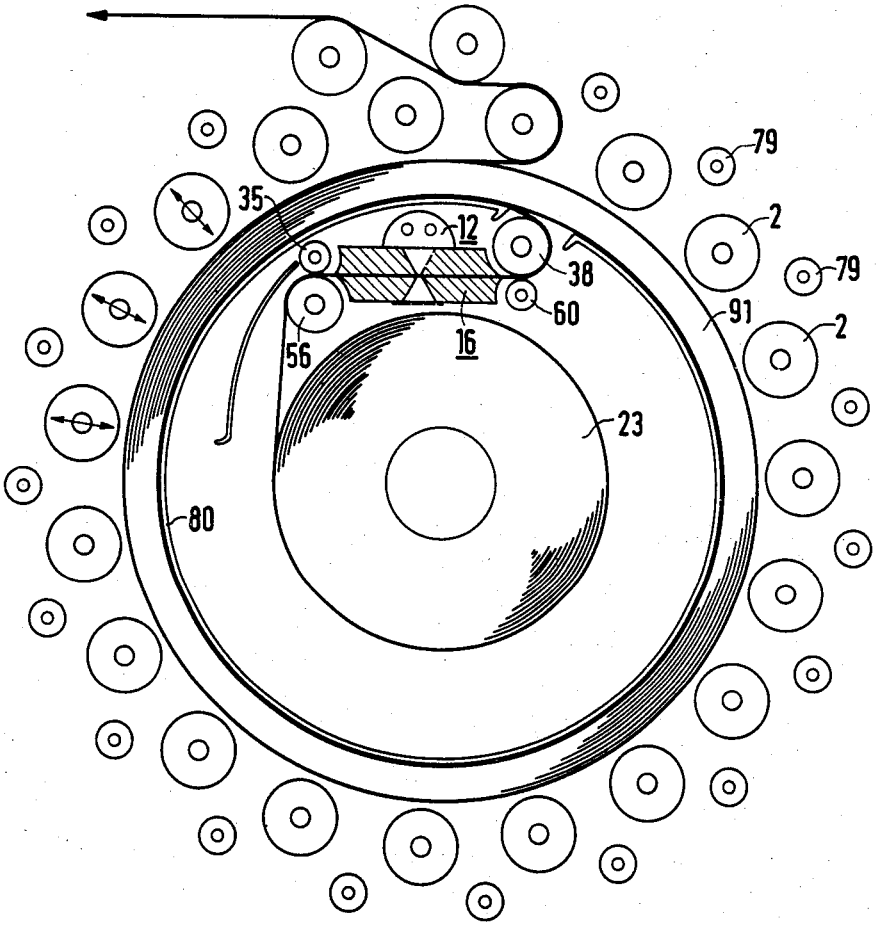
FIG. 9 shows the apparatus in FIG. 7 with fully wound auxiliary coil.

Based upon the apparatus in accordance with FIG. 1, 2, 3 and 4 and after completing the threading process of the band leading edge described therein from the supply coil 23 through the clamping device 16 and the slot of auxiliary cylinder 80 through two rollers 2 of the support roller ring to the outside to the manufacturing unit, drive motor 28 for spool spindle 11, motor 37 for the discharge drive roller 38 and drive motor 87 for roller ring 9 of support rollers 2 are switched on and controlled so that the band is mated against the form-generating rollers 79. During this feed cycle to generate a storage coil 62, roller ring 9 and auxiliary cylinder 80 move in a synchronous fashion. As the feed cycle continues, support rollers 2 are moved by means not further shown by such an extent in a radial fashion in the direction of the rotating axis that the storage coil can build up in an inward fashion (FIG. 8). Once the band has completely unwound from the supply coil, i.e., the band end has reached the processing slot between the tensioning jaws 58, 59, the above-specified drive motors are stopped and spool spindle 11 is supplied with a new supply coil. After it is threaded into the welding and clamping device 12, 16 in the fashion previously described, the welding procedure starts with the auxiliary cylinder 80 stopped. At the same time, the further manufacturing unit is activated and drive motor 87 for roller ring 9 is activated in a reverse direction of rotation. Due to the band pull exerted by the manufacturing unit in conjunction with roller ring 9 turning in the unwinding direction, one section of the band stored on storage coil 62 is uncoiled in the manufacturing unit, the other section wound onto the auxiliary cylinder 80 in its rest position so that on the latter an auxiliary coil 91 is formed once the storage coil 62 has been completely unwound (FIG. 9). At the same time support rollers 2 are again moved radially outwards to reestablish their original position for building a subsequent storage coil. Immediately after storage coil 62 has be unwound and the welding cycle completed, the direction of rotation contrary to its previous direction of rotation is effected so that auxiliary coil 91 passes from auxiliary cylinder 80 into the manufacturing unit. After the auxiliary coil 91 has been unwound, the direction of rotation of motor 85 for auxiliary cylinder 80 is reversed and at the same time motor 87 for roller ring 9 is switched on. Now roller ring 9 and auxiliary cylinder 80 again move in a synchronous fashion so that a new storage coil can be formed in the described fashion, while simultaneously unwinding the band in order to feed the manufacturing unit. The described process then can be repeated in a continuous fashion.

A further advantage of the embodiment described in FIG. 7 to 10 is that the welding process itself can be performed with the welding device standing still.

It will now be understood that there has been disclosed a new, improved method and apparatus for welding bands of finite length supply coils to form continuous bands in a continuous, non-stop operation for further manufacturing which requires less space, less skilled labor to operate, and improves material handling costs. As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A method for welding rolled bands of finite length supply coils into a continuous band during a manufacturing operation, utilizing electrical sensing and control devices, comprising the steps of:

winding a first band of finite length from a smaller diameter supply coil into a larger diameter, concentrically located storage coil having sufficient length to uncoil and supply the manufacturing operation during a welding of a trailing band end of the first band;

clamping the trailing band end in a discharge side of a clamping and welding device located between an internal diameter of the storage coil and an external diameter of the supply coil;

inserting a second band of finite length as a subsequent supply coil and uncoiling a leading end thereof into a feed side of the clamping and welding device; and clamping and welding the leading end of the second band supply coil to the clamped trailing end of the first band storage coil during the uncoiling of the storage coil into the manufacturing operation, the welding is accomplished in the clamping and welding device in a fixed position relative to the storage coil.

2. A method for welding rolled bands of finite length supply coils into a continuous band during a manufacturing operation, utilizing electrical sensing and control devices comprising the steps of:

winding a first band of finite length from a smaller diameter supply coil into a main storage coil wound on the outside of a rotating roller ring located concentrically around the supply coil, and also into an auxiliary storage coil located between the supply coil and the main storage coil, the first band having sufficient length to uncoil and supply the manufacturing operation during welding of a trailing end of the first band;

clamping the trailing band end in a discharge side of a clamping and welding device located between an internal diameter of the auxiliary storage coil and an external diameter of the supply coil;

inserting a second band of finite length as a subsequent supply coil and uncoiling a leading end thereof into a feed side of the clamping and welding device; and clamping and welding the leading end of the second supply band supply coil to the clamped trailing end of the first band auxiliary storage coil, in a fixed position relative to the auxiliary storage coil; wherein the band initially wound from the supply coil through a slot of the auxiliary storage coil cylinder onto the roller-ring as the main storage coil rotating synchronously with the supply coil, and thereafter a portion of band from the main storage coil is fed to the manufacturing operation, while the remaining portion is wound, during the welding of the ends, around the non-rotating auxiliary storage coil and then unwound and passed on to the manufacturing operation in order to facilitate insertion of a subsequent band supply coil.

3. A method according to claim 1, further comprising the steps of:

inserting the leading end of the band winding of the first supply coil inserted into guide mechanisms of the clamping and welding device by a coil drive means until the band leading end is grasped by feed drive rollers of the clamping and welding device;

feeding by the feed drive rollers, each roller band through open clamping jaws of the clamping and welding device into the discharge drive of the clamping and welding device;

feeding by the discharge rollers a roller band between two rollers, of the rotating roller-ring mounted concentrically around the supply coil, outward, supplying the band leading end to a not yet running manufacturing operation where it is grasped;

rotating by means of a drive motor, the roller-ring and the clamping and welding device connected thereto, in a winding direction of the supply coil but opposite in direction to the band being passed through the manufacturing operation winding the band from the supply coil outside the roller-ring as the storage coil until the band trailing end of the storage coil reaches the feed drive roller;

slowing down the rotatory speed of the roller-ring until an edge of the band trailing end aligns with a welding path of the clamping and welding device;

closing the second set of clamping jaws located away from the feed side of the guiding mechanism clamping the trailing end and simultaneously disconnecting the roller drive;

operating the roller drive in a direction supplying band to the manufacturing operation and operating the manufacturing operation;

inserting a subsequent supply coil into a center position of the roller-ring;

inserting a leading end of the subsequent supply coil into the guiding devices of the clamping and welding mechanism by the coil drive means until grasped by feed drive rollers of the clamping and welding device;

feeding, by the feed drive rollers, into contact with the trailing end of the preceding storage coil;

interrupting, simultaneously with the previous step, the drive motor of the feed drive roller;

closing the clamping jaws facing the feed side of the clamping and welding device, follwed by operating a drive motor of a planing-or-milling device attached to the clamping and welding device driving the planing or milling device as an edge finisher for the traversal along a slide rest for concurrently finishing the trailing end edge of the first supply coil and the leading end edge of the subsequent supply coil;

sliding the feed side and the discharge side clamping jaws together the extent of the gap formed by the planing or milling traversal, abutting the two edges;

driving, by the planing and milling drive motor, a welding device along a second slide rest across the abutting edges for the duration of the traversal of a welding path of the welding device;

opening both sets of clamping jaws at the completion of the welding, and reversing the direction of rotation of the roller-ring unwinding the supply coil;

stopping the roller-ring drive motor shortly before the supply coil is completely unwound and subsequently starting the roller-ring drive motor in a reverse direction and controlling the roller-ring rotational speed thereby passing the supply coil slowly through the opened clamping jaws until a trailing end of the supply coil is located across the welding path, whereupon the clamping jaws on the discharge side of the clamping and welding device close and concurrently the rotational velocity of the roller-ring is adjusted to the supplying speed of the band to the manufacturing operation;

inserting a new supply coil having a leading end inserted by the coil drive into the guiding device of the clamping and welding device until grasped by the feed drive roller of the clamping and welding device and conducting the leading end until it contacts the trailing end of the preceding storge coil; and repeating the cycle of steps after each insertion of a new supply coil as required.

4. A method according to claim 1, further comprising the steps of:

inserting a leading end and a roller band of a supply coil, subsequent to inserting a the supply coil, into a guiding device of a clamping and welding device by a coil drive until the leading end is grasped by feed drive rollers of the clamping and welding device;

feeding the roller band through open clamping jaws of the clamping and welding device by the feed drive rollers to discharge drive rollers of the clamping and welding device;

conducting the roller band by the discharge drive rollers between rollers of a fixed-mount roller-ring, towards a manufacturing operation such that the leading end is passed to and grasped by the manufacturing operation which at this time is not yet begun manufacturing operation;

rotating by means of clamping and welding device drive motor in a direction of a winding direction of the supply coil and a direction of the band travelling toward the manufacturing operation, having the band pressed by discharge drive rollers against the inner side of the roller ring rollers forming the storage coil and wound layer upon layer until a trailing band end reaches the discharge drive rollers;

slowing the rotating until the trailing band end is located across the welding path of the clamping and welding device;

closing clamping jaws on the discharge side of the clamping and welding device and simultaneously interrupting the clamping and welding device drive motor;

placing the manufacturing operation and the clamping and welding device in motion in a direction counter to movement of the band;

placing a subsequent supply coil on a now empty supply coil spindle;

feeding a band leading end of the subsequent supply coil by the supply coil drive into the guiding devices of the clamping and welding device until grapsed by the feed drive rollers;

conducting the subsequent leading end by the feed drive rollers into contact with the trailing end of the preceding storage coil;

interrupting the feed drive roller drive motor simultaneously with closing the clamping jaws on the feed side of the clamping and welding device;

starting a planing or milling device and driving it along the slide rest in a direction of the welding path traversing the leading end and the trailing end in one pass;

slipping both the sets of clamping jaws together closing a gap formed between the ends during the planing or milling;

operating the slide drive motor of the clamping and milling device driving a welding device along the welding path traversing the edges in one welding pass;

opening both sets of clamping jaws after the welding pass; slowing down the clamping and welding device drive motor rotational velocity and then reversing the direction of rotation thereof; before a complete unwinding of the subsequent supply coil, the drive motor of the clamping and welding device again slows down the rotational velocity and then continues in the reverse direction with a controlled rotational velocity passing a trailing end of the subsequent supply coil slowly through the open clamping jaws until an edge of the trailing end aligns with the welding path;

closing the clamping jaws on the discharge side of the clamping and welding device and simultaneously adjusting the rotational velocity of the clamping and welding device to the speed of the band in the discharge direction;

inserting a further supply coil on the supply spindle;

inserting by the supply coil drive a band leading end through the guiding devices of the clamping and welding device until grasped by the feed drive rollers;

feeding the further supply coil leading end into contact with the trailing end of the band being held in the discharge side clamping jaws;

repeating the entire continuous cycle, starting with the planing and milling step, as required.

5. A method according to claim 2, further comprising the steps of:

inserting by means of the supply coil drive after insertion of the supply coil the band leading end of the supply coil into the guiding devices of the clamping and welding device until the leading end is grasped by feed drive rollers of the clamping and welding device;

feeding by the feed drive rollers the supply band through open clamping jaws of the clamping and welding device to discharge drive rollers;

feeding by the discharge drive rollers, the band through a slot of an auxiliary cylinder which is fixedly connected to the clamping and welding device and concentrically located around the supply coil in between two rollers of a roller ring of a storage coil rotating concentrically around an auxiliary coil outwards so that the band leading end can be supplied to and grasped by a not yet operating manufacturing operation;

placing in rotary motion the roller ring of the storage coil coupled with the auxiliary cylinder by means of a drive motor in the same direction as the winding direction of the supply coil, but counter to the direction of the band moving to the manufacturing operation, winding the band from the supply coil on the outside of the roller ring as the storage coil until the trailing band end of the storage coil reaches the feed drive rollers;

slowing down the rotation of the roller ring until the trailing end of the band is located along the welding path of the clamping and welding device;

closing clamping jaws on the discharge side of the clamping and welding device and simultaneously interrupting the feed roller drive;

moving the leading band end in a direction into the manufacturing operation by the roller drive and grasping it by the manufacturing operation, and simultaneously disconnecting the roller drive from the auxiliary cylinder while the auxiliary cylinder is still stopped, thereby an outer portion of the storage coil is fed to the manufacturing opertion and an inner portion wound on the outer layer of the auxiliary cylinder;

inserting a subsequent supply coil;

inserting by means of the supply coil drive a band leading end of the subsequent supply coil, into the guiding devices of the clamping and welding device until the feeding band end is grasped by the feed drive rollers conducting it into contact with the trailing band end presently located along the welding path;

interrupting the feed drive roller drive motor and simultaneously closing the clamping jaws on the feed side of the clamping and welding device;

starting a drive motor of the clamping and welding device;

driving a planing and milling device along a slide traversing both of the ends in one pass;

sliding both sets of clamping jaws together removing a gap formed between the two band ends during the planing and milling at the completion of the planing and milling pass, and driving a welding device by the drive motor towards the contacting ends traversing the ends in a welding pass;

opening both sets of clamping jaws subsequent to the welding pass welding the ends together;

rotating the roller ring drive motor in an opposite direction after successful winding of the band supply coil from the storage cylinder onto the auxiliary cylinder in order to unwind the band supply positioned on the auxiliary cylinder;

recoupling the storage cylinder and the auxiliary cylinder after unwinding the band supply located on the auxiliary cylinder and reversing the drive forming a subsequent storage coil;

stopping the roller ring drive motor and the auxiliary cylinder before the storage coil has become completely uncoiled, and decoupling the auxiliary cylinder from the roller ring drive motor;

restarting the roller ring drive motor in a reverse direction and controlling the speed of the drive motor thereby passing the trailing band end of the storage coil slowly through the opened clamping jaws of the clamping and welding device until the trailing band end is aligned along the welding path of the clamping and welding device;

closing the clamping jaws on the discharge side of the clamping and welding device and simultaneously adjusting the rotational velocity of the roller drive to the conveying velocity of the band;

inserting a further new supply coil;

inserting by means of the coil drive a leading end of the further supply coil into the guiding devices of the clamping and welding device until the leading end is grasped by the feed drive rollers in the clamping and welding device until the leading end is grasped by the feed drive rollers in the clamping and welding device until the leading end contacts the trailing end of the band presently grasped in the clamping jaws located on the discharge side of the clamping and welding device; and repeating the steps from planing and welding to the insertion of a new supply coil and a new leading end as required.

6. An apparatus for welding rolled bands of finite lengths to form a continuous band used in manufacturing comprising:

a disc-shaped mounting plate having a center and axis normal to the center;

a mounting ring having an external diameter the same as the disc-shaped mounting plate located parallel and coaxial thereto;

a plurality of axes of rollers distributed around the circumferences of the plate and the ring and connected thereto;

a roller rotating horizontally about each one of the plurality of axes forming a roller-ring coaxial with the central axis;

a removable mounting spindle for mounting a supply coil of a roller band located coaxial and concentric to the central axis;

a drive mechanism pivotally mounted to the mounting spindle having a rotary axis coaxial to the central axis;

a clamping and welding device connected to the plate and the ring is located between the supply coil and the roller ring for welding a trailing end of a previous roller band to a leading end of a subsequent sequential roller band having as components:

feed drive rollers;

discharge rollers;

a feed side clamping mechanism;

a discharge side clamping mechanism cooperating with the feed side clamping mechanism to bring together the roller band ends for a movable planing or milling device, attached to the clamping and welding device, for planing the ends into mating edges;

a welding device, connected to the plate and the clamping and welding device, for welding of the mating edges; and a controller computer controlling an electrical motor drive mechanism providing a variable rotational speed and direction of the roller-ring, the clamping and welding device and the roller band supply coil around the central axis of the mounting plate, the control computer also controlling: the feed side and the discharge side clamping devices actuation; and a slide drive motor of the clamping and welding device providing slide drive for the planing or milling device and also for the welding device; wherein the controlling is provided as a function of an amount of the roller band wound on the roller-ring as a storage coil and a feed rate the roller band is supplied to the manufacturing operation to complete a welding of the mating edges of the roller band ends before the storage coil has been completely uncoiled to the manufacturing operation.

7. An apparatus according to claim 6, wherein:

the roller ring is fastened to the clamping and welding device;

the clamping and welding device having attached thereto discharge drive rollers for leading the roller band uncoiled from the supply coil from an interior area of the roller-ring, between two rollers of the roller-ring to an exterior area of the roller-ring providing the storage coil to be wound on the exterior of the roller ring as the roller ring is rotated in a direction counter to a direction of the roller band; and the roller axes mounting on the mounting plate and the mounting ring with a freedom to radially shift against radial force means connected thereto, for controlling and adjusting the external diameter of the roller ring as a function of the winding thickness of the storage coil.

8. An apparatus according to claim 6, wherein the clamping and welding device, during a stoppage of the roller ring, is driven in either direction of rotation having an axis of the roller ring co-axial with the axis of the clamping and welding device rotation, and;

the discharge drive rollers cooperate in conducting the roller band outwards as the band unwinds from the supply coil through two rollers of the roller ring, and in winding the storage coil on the inside of the roller ring pressing outward against the rollers.

9. An apparatus for welding rolled bands of finite length supply coils into a continuous band during operation of a continuous manufacturing operation, utilizing electrical sensing and control devices, comprising:

a disc-shaped mounting plate having a central axis through the center thereof;

a plurality of rollers distributed around the peripheral circumference of the plate and attached on horizontal axes forming a roller-ring coaxial with the central axis;

a mounting spindle, rotatable around the central axis for mounting of a roller band supply coil;

a spindle drive mechanism attached to the mounting spindle for rotating the spindle and the mounted supply coil;

a second plurality of rollers concentrically surrounding the roller ring and fixedly mounted to the plate forming a form-generating roller cage spaced radially from the roller ring to provide adequate space for a storage coil to be wound;

an auxiliary cylinder, which can be independently rotated and having a slot therein to conduct the roller band discharged from a clamping and welding device, located in an annular space between the spindle and the roller ring and of adequate size for an auxiliary storage coil to be wound;

a clamping and welding device connected to the inside of the auxiliary cylinder including:

a feed drive motor connected to the clamping and welding device;

two feed side drive rollers connected to the feed drive motor;

a discharge drive motor connected to the clamping and welding device;

two discharge rollers connected to the discharge drive motor;

a discharge side clamping mechansim connected to the clamping and welding device for clamping the trailing end of the storage coil;

a feed side clamping mechanism connected to the clamping and welding device for clamping the leading end of the supply coil;

a planing and milling device connected to the clamping and welding device for preparing both the clamped ends for welding;

means for moving planed, clamped ends together attached to both the clamping mechanisms; and a welding device as part of the clamping and welding device for welding the processed ends together;

a first drive mechanism for rotating the roller ring;

a second drive mechanism for rotating in either direction the auxiliary cylinder and the attached clamping and welding device cooperating with the first drive mechanism to connect the auxiliary cylinder during winding of the storage coil on the roller-ring to the first drive, and during a welding cycle of the welding device the auxiliary cylinder is decoupled from the first drive mechanism to handle the roller band on the roller ring as it passes onto the auxiliary cylinder, wherein the auxiliary cylinder is fixed in a position and the discharge drive rollers feed the roller band wound from the supply coil through the slot and between the two rollers of the roller ring towards the manufacturing operation providing during the coupling of the roller ring and the auxiliary cylinder in rotation contrary to the conveying unit of the roller band, the roller band can be wound on the outside of roller ring as the storage coil, and the roller axes of the rollers are radially adjustable up to a maximum thicknes of the storage coil controlled by radial adjustment force means for controlling an inner diameter of the storage coil with respect to its winding thickness; and a control computer controlling the first drive mechanism, the second drive mechanism, the feed drive rollers, the discharge drive rollers, the feed side clamps, the discharge side clamps, the supply coil drive, the end planing, the end welding, the cooperation of the roller ring and the auxiliary cylinder, and rotational direction and speed of the roller ring, auxiliary cylinder, clamping and welding device and supply coil, around the central axis providing as a function of the rotation and the length of band on the storage coil, actuation of: the clamping mechanisms, the planing and milling slide feed, and the welding slide feed, providing welding of the roller band ends before the length of the band on the storage coil is completely uncoiled.

10. An apparatus according to claim 6, further comprising a laser as the welding device having an energy ray generator associated therewith and having an energy ray conducted coaxially to the central axis to the inside of the plate and routed to the ends to be welded by a plurality of deflector mirrors, one of which can be moved in the direction of the seam welding path.

11. An apparatus according to claim 7, further comprising a laser as the welding device having an energy ray generator associated therewith and having an energy ray conducted coaxially to the central axis to the inside of the plate and routed to the ends to be welded by a plurality of deflector mirrors, one of which can be moved in the direction of the seam welding path.

12. An apparatus according to claim 8, further comprising a laser as the welding device having an energy ray generator associated therewith and having an energy ray conducted coaxially to the inside of the plate and routed to the ends to be welded by a plurality of deflector mirrors, one of which can be moved in the direction of the seam weld.

13. An apparatus according to claim 9, further comprising a laser as the welding device having an energy ray generator associated therewith and having an energy ray conducted coaxially to the central axis to the inside of the plate and routed to the ends to be welded by a plurality of deflector mirrors, one of which can be moved in the direction of the seam welding path.

14. An apparatus according to claim 6, further comprising an electrical welding device as the welding device having two rollers as welding electrodes located above and beneath the bands to be welded, and having a foil band which serves as a welding material uncoiling from supply rollers and feeding to the roller electrodes and positioned between the roller band and each of the roller electrodes.

15. An apparatus according to claim 7, further comprising an electrical welding device as the welding device having two rollers as welding electrodes located above and beneath the bands to be welded, and having a foil band which serves as a welding material uncoiling from supply rollers and feeding to the roller electrodes and positioned between the roller bands and each of the roller electrodes.

16. An apparatus according to claim 8, further comprising an electrical welding device as the welding device having two rollers as welding electrodes located above and beneath the bands to be welded, and having a foil band which serves as a welding material uncoiling from supply rollers and feeding to the roller electrodes and positioned between the roller bands and each of the roller electrodes.

17. An apparatus according to claim 9, further comprising an electrical welding device as the welding device having two rollers as welding electrodes located above and beneath the bands to be welded, and having a foil band which serves as a welding material uncoiling from supply rollers and feeding to the roller electrodes and positioned between the roller band and each of the roller electrodes.

* * * * *